US009587371B1

(12) United States Patent
Hostetler

(10) Patent No.: US 9,587,371 B1
(45) Date of Patent: Mar. 7, 2017

(54) REVERSIBLE BUCKET ATTACHMENT SYSTEM FOR A SKID STEER

(71) Applicant: Randy Hostetler, Somerset, PA (US)

(72) Inventor: Randy Hostetler, Somerset, PA (US)

( * ) Notice: Subject to any disclaimer, the term of this patent is extended or adjusted under 35 U.S.C. 154(b) by 324 days.

(21) Appl. No.: 14/312,841

(22) Filed: Jun. 24, 2014

(51) Int. Cl.
*E02F 3/40* (2006.01)
*E02F 3/65* (2006.01)
*E02F 3/64* (2006.01)

(52) U.S. Cl.
CPC ..... *E02F 3/653* (2013.01); *E02F 3/6454* (2013.01); *E02F 3/6463* (2013.01); *Y10S 414/125* (2013.01); *Y10S 414/133* (2013.01)

(58) Field of Classification Search
CPC ..... E02F 3/653; E02F 3/6454; E02F 3/6463; Y10S 414/125; Y10S 414/133
USPC ..... 414/723
See application file for complete search history.

(56) References Cited

U.S. PATENT DOCUMENTS 2,760,284 A * 8/1956 Cook ..... E02F 3/6463 37/417
2,764,824 A 10/1956 Kepner
3,257,745 A 6/1966 Crumb
3,581,924 A 6/1971 Helmut
4,042,141 A * 8/1977 Schweigert ..... E02F 3/3604 414/703
4,143,783 A 3/1979 Cochran
4,333,250 A * 6/1982 Henderson ..... A01B 59/06 172/272
4,928,410 A 5/1990 Walters
4,948,328 A * 8/1990 Busch ..... E02F 3/3636 172/273
D322,792 S 12/1991 Park
D344,961 S 3/1994 Kallen
5,921,743 A 7/1999 Slagter
6,996,925 B2 2/2006 Harding
2008/0025830 A1* 1/2008 Pielmeier ..... E02F 3/3609 414/723
2010/0239405 A1* 9/2010 Tesinsky ..... B66F 9/16 414/686

FOREIGN PATENT DOCUMENTS

GB 2191169 12/1987

* cited by examiner

*Primary Examiner* — Scott Lowe

(57) ABSTRACT

The reversible bucket attachment system for a skid steer includes a mounting plate that is configured to attach to a skid steer or any vehicle. The mounting plate includes an armature that extends rearwardly, and includes a pivoting point on a distal end. The pivoting point enables a bucket to attach thereto. Moreover, the bucket is able to pivot with respect to the armature via the pivoting point. The bucket is able to rotate from a generally parallel orientation with respect to the armature to an obtuse orientation. The bucket is further defined with an inner surface and an outer surface. The mounting plate is configured to attach to the skid steer or vehicle in one of two positions.

1 Claim, 5 Drawing Sheets

REVERSIBLE BUCKET ATTACHMENT SYSTEM FOR A SKID STEER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of bucket attachment systems, more specifically, a reversing buck attachment that is configured for use with a skid steer.

SUMMARY OF THE INVENTION

The reversible bucket attachment system for a skid steer includes a mounting plate that is configured to attach to a skid steer or any vehicle. The mounting plate includes an armature that extends rearwardly, and includes a pivoting point on a distal end. The pivoting point enables a bucket to attach thereto. Moreover, the bucket is able to pivot with respect to the armature via the pivoting point. The bucket is able to rotate from a generally parallel orientation with respect to the armature to an obtuse orientation. The bucket is further defined with an inner surface and an outer surface. The mounting plate is configured to attach to the skid steer or vehicle in one of two positions. The mounting plate is able to attach to the skid steer or vehicle with the inner surface of the bucket configured to engage a ground surface. Alternatively, the mounting plate is able to attach to the skid steer or vehicle with the outer surface of the bucket configured to engage the ground surface. When the bucket is reversed such that the outer surface of the bucket is configured to engage the ground surface, a turnbuckle is optionally used to attach from a turnbuckle plate to a turnbuckle bracket provided on an inner surface of the bucket.

It is an object of the invention to provide a bucket attachment for a skid steer or any vehicle, and which can be reversed to provide different ground-moving capabilities.

These together with additional objects, features and advantages of the reversible bucket attachment system for a skid steer will be readily apparent to those of ordinary skill in the art upon reading the following detailed description of presently preferred, but nonetheless illustrative, embodiments of the reversible bucket attachment system for a skid steer when taken in conjunction with the accompanying drawings.

In this respect, before explaining the current embodiments of the reversible bucket attachment system for a skid steer in detail, it is to be understood that the reversible bucket attachment system for a skid steer is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the reversible bucket attachment system for a skid steer.

It is therefore important that the claims be regarded as including such equivalent construction insofar as they do not depart from the spirit and scope of the reversible bucket attachment system for a skid steer. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
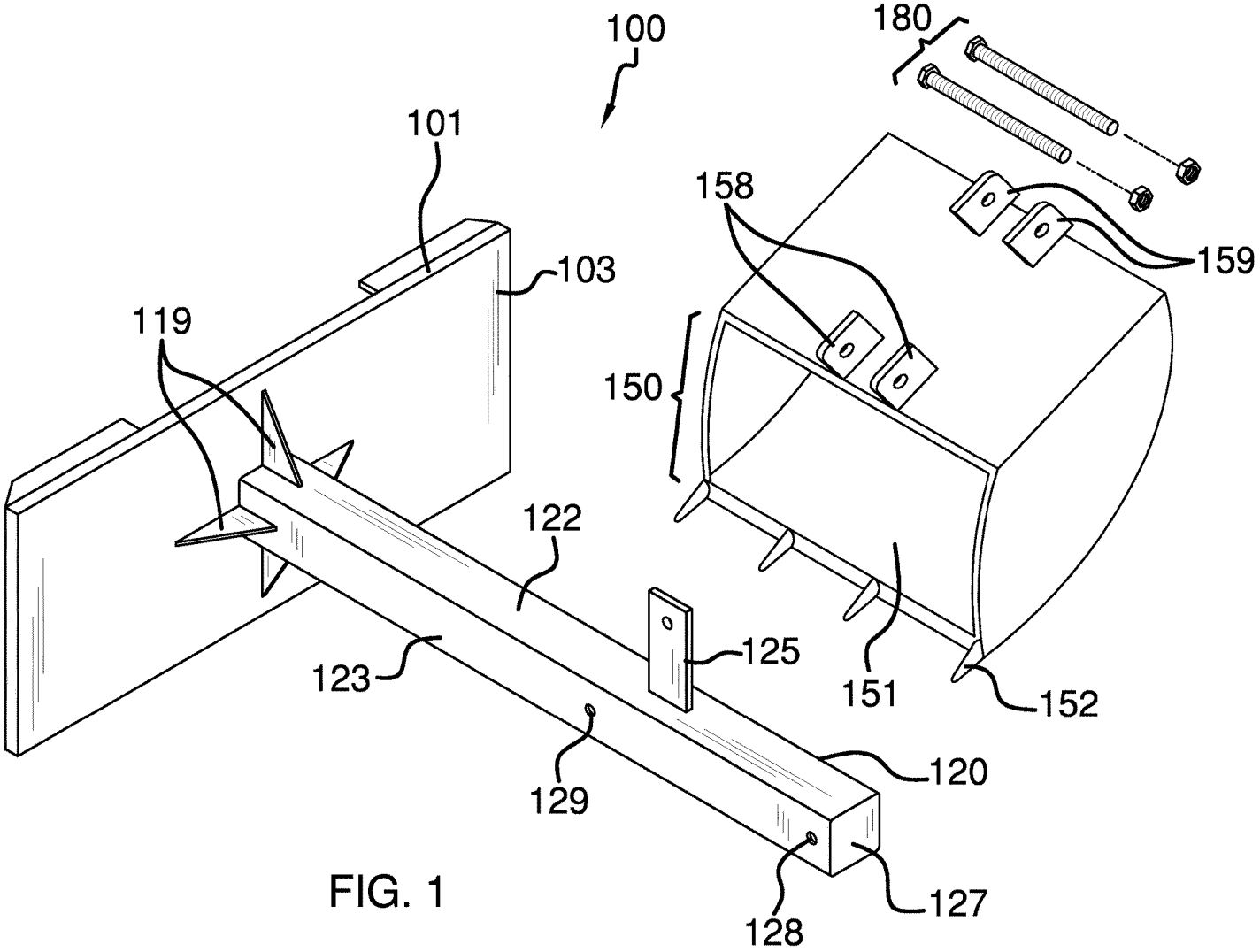
FIG. 1 illustrates a perspective view of the mounting plate and armature.
Figure 2:
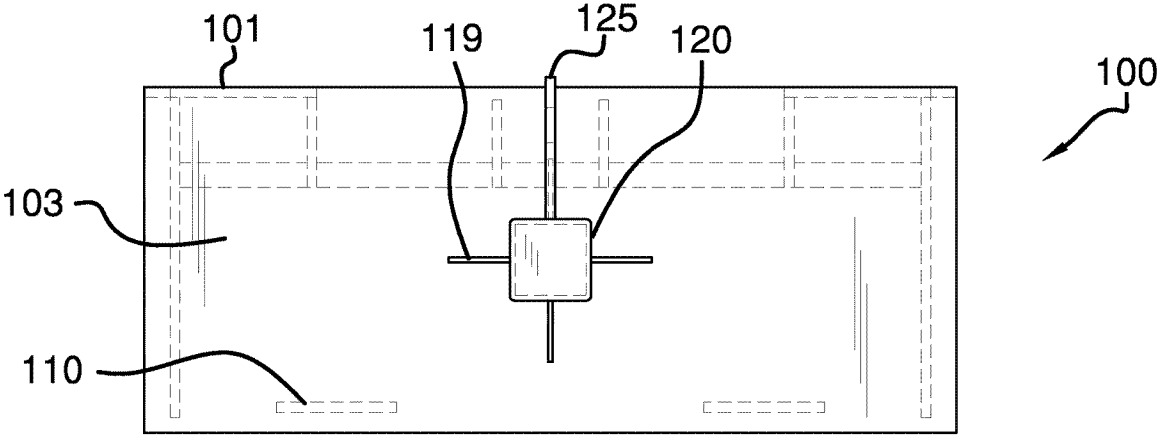
FIG. 2 illustrates an end view of the mounting plate.
Figure 3:
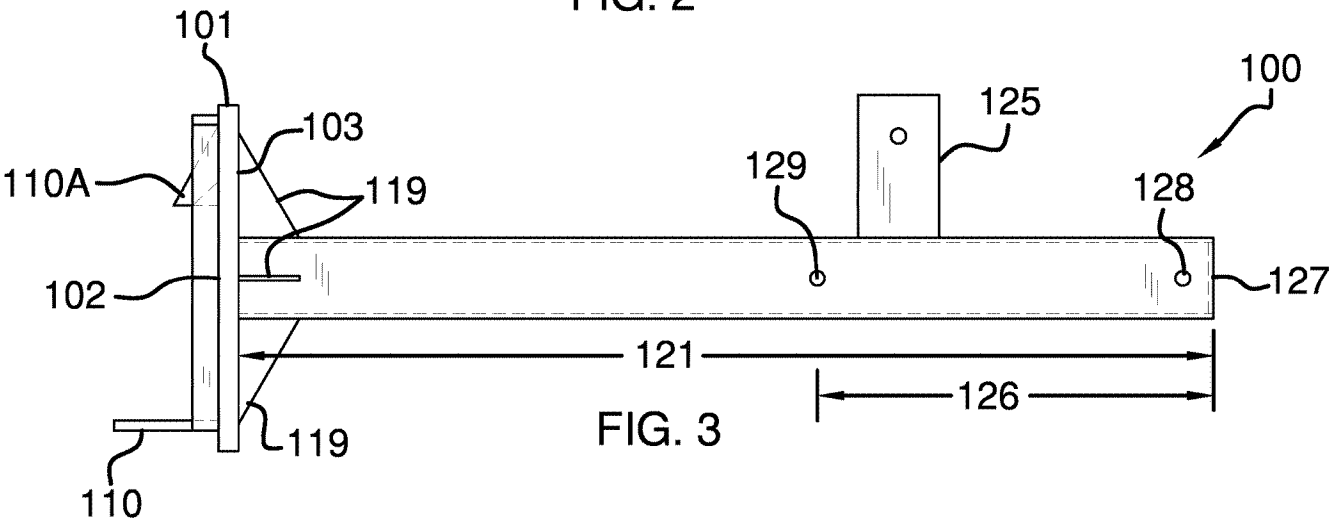
FIG. 3 illustrates a side view of the mounting plate and armature.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A reversible bucket attachment system for a skid steer 100 (hereinafter invention) is further defined with a mounting plate 101 that is further defined with a forward surface 102 and a rear surface 103. The mounting plate 101 is either rectangular or square in shape. The rear surface 103 includes attachment tabs 110 thereon, and which are configured to attach to a skid steer 200. It shall be noted that the invention 100 is adapted for use with the skid steer 200, but may also be configured for use with any vehicle, and is not limited to any one particular type of vehicle. The attachment tabs 110 works in concert with a top attachment bracket 110A to secure the invention 100 onto a rear attachment member 201 of the skid steer 200. It shall be noted that the rear attachment member 201 is well known in the art.

The rear surface 103 is affixed to an armature 120. The armature 120 may be made of a piece of square stock, and includes an armature length 121. The armature 120 is affixed to the rear surface 103 of the mounting plate 101 via a plurality of gusset members 119. The armature length 121 ranges from not less than one foot to not more than 30 feet. The armature 120 is further defined with a top armature surface 122, and side armature surfaces 123. The side armature surfaces 123 includes a first armature mounting hole 128 and a second armature mounting hole 129. The first armature mounting hole 128 is adjacent to an armature distal end 127 whereas the second armature mounting hole 129 is inset an armature mounting hole distance 126. The top armature surface 122 includes a turnbuckle plate 125.

The armature 120 is responsible for supporting a bucket 150 on the invention 100. Moreover, the bucket 150 is configured for dragging behind the vehicle 200 in order to move or spread dirt of a dirt surface 300. The bucket 150 is further defined with an inner surface 151 having bucket teeth 152. The bucket 150 also has an outer surface 153. The invention 100 is able to support the bucket 150 in one of two configurations. The first configuration (see FIG. 4) has the bucket teeth 152 are partially submerged and the inner surface 151 is able to collect dirt as the vehicle 200 moves forward. Moreover, in the first configuration, the bucket 150 has a leading bucket edge 155 that forms an acute angle 156 with respect to the ground surface 300.

Figure 5:
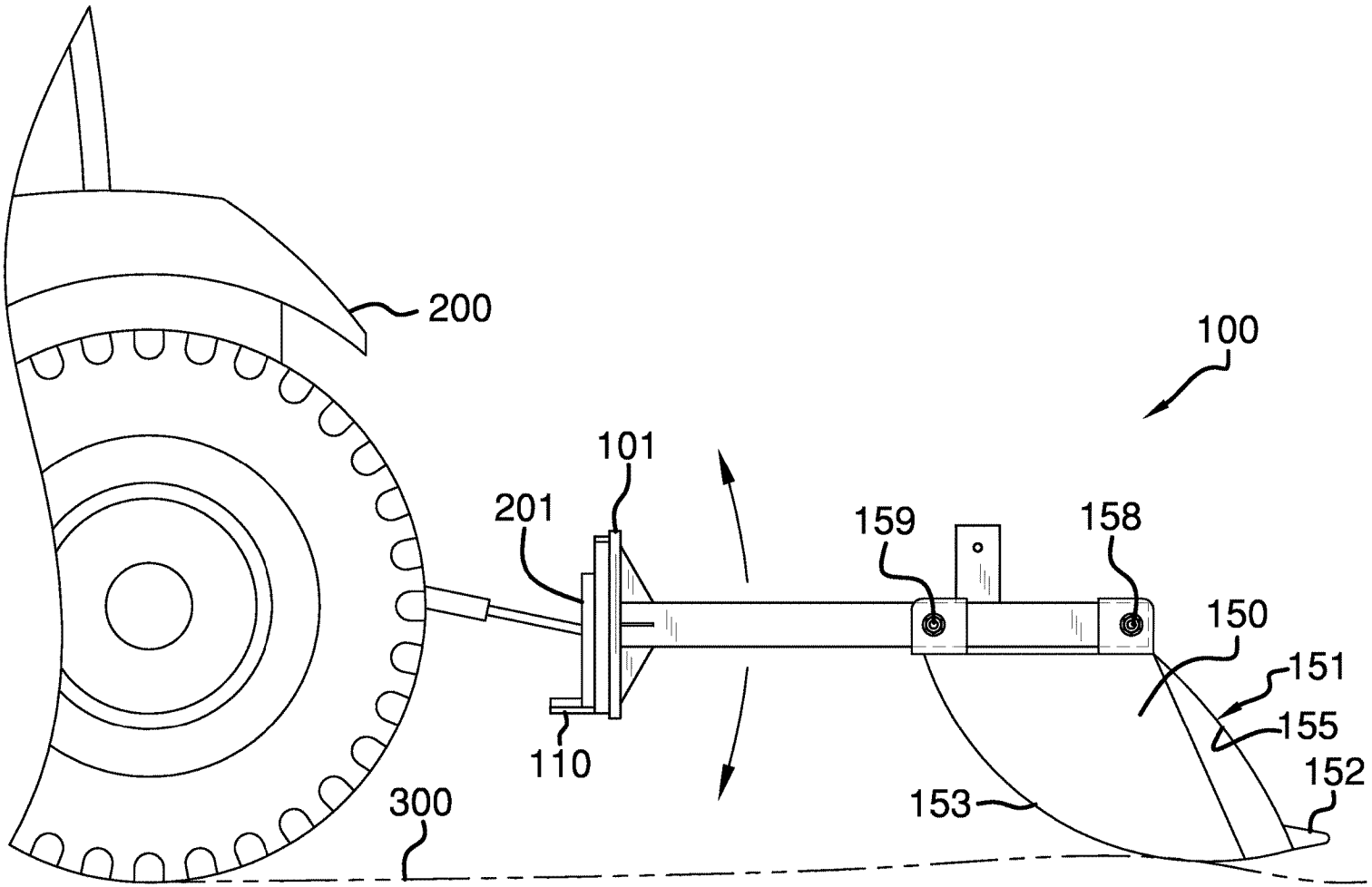
FIG. 5 illustrates a view of the reversible bucket attachment system in which the inner surface of the bucket engaged against the ground surface.
Figure 6:
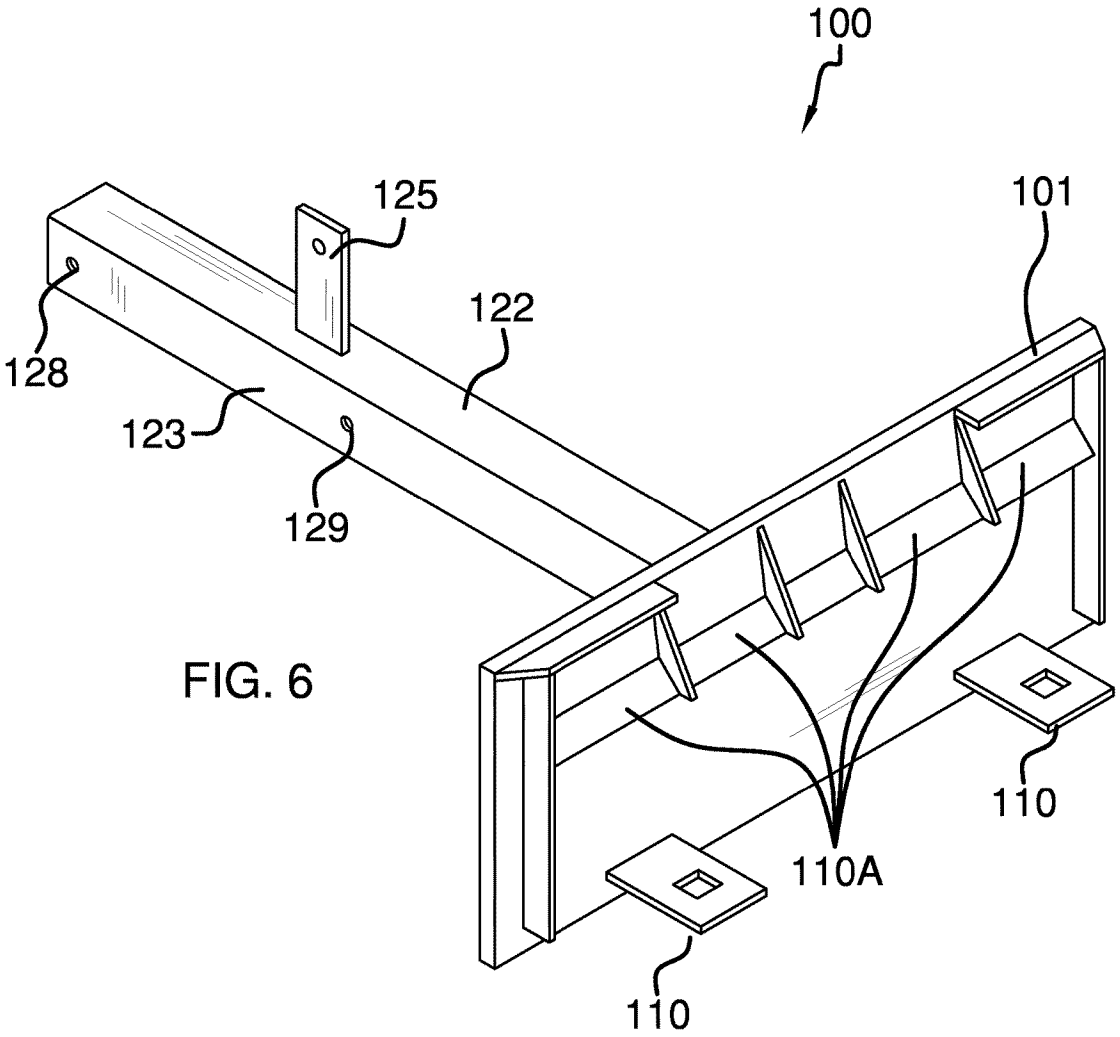
FIG. 6 illustrates a rear, perspective view of the mounting plate and armature.

The second configuration has the bucket 150 oriented backwards such that the outer surface 153 engaging the ground surface 300 (see FIG. 5). The bucket 150 is further defined with a first mounting point 158 and a second mounting point 159. The first mounting point 158 is located adjacent the leading bucket edge 155; whereas the second mounting point 159 is provided adjacent the outer surface 153.

Figure 4:
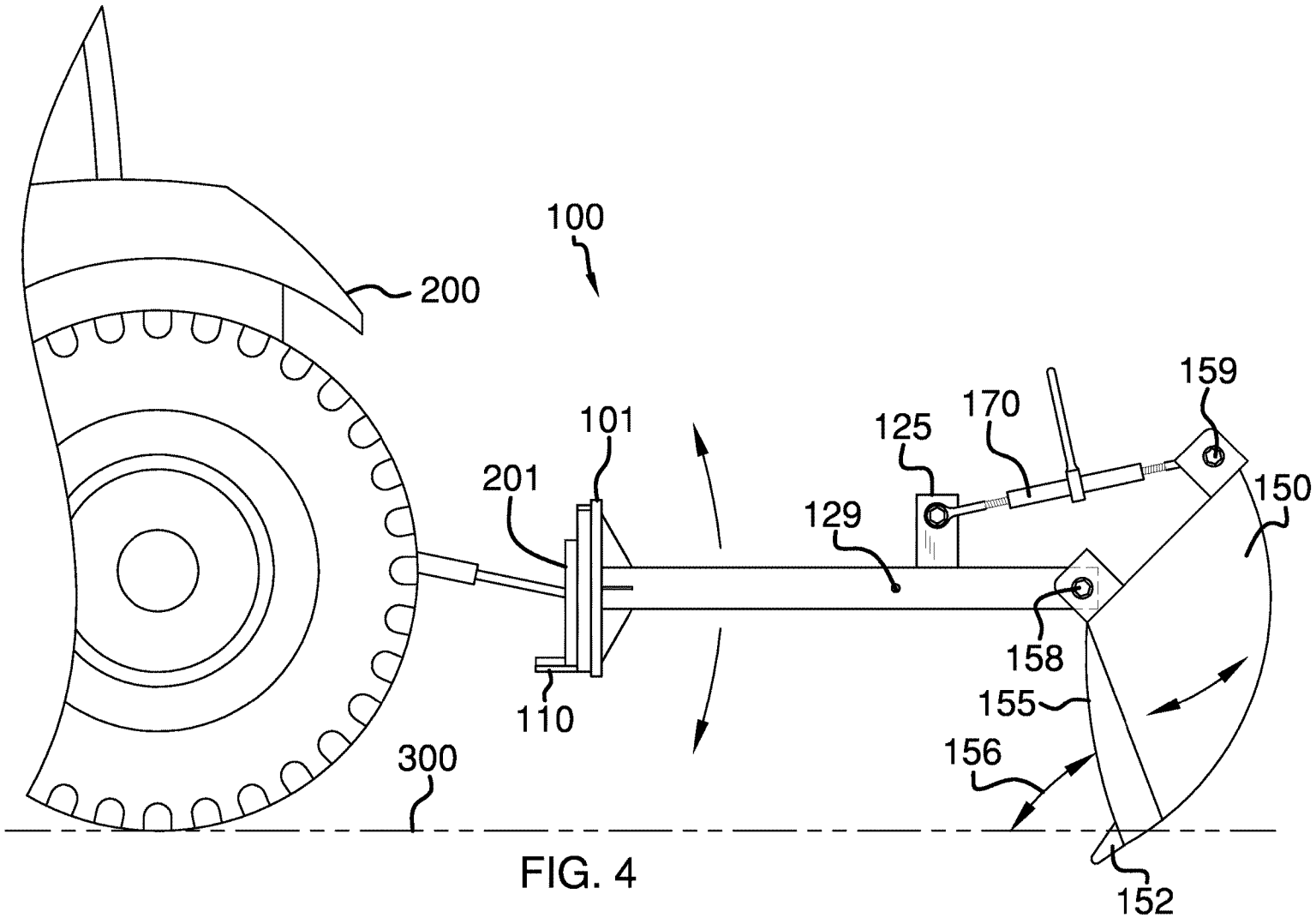
FIG. 4 illustrates a side view of the reversible bucket attachment system attached to a skid steer with the outer surface of the bucket engaged against the ground surface.

In FIG. 4, the first mounting point 158 of the bucket 150 is bolted to the first armature mounting hole 128, and a turnbuckle 170 connects between the second mounting point 159 of the bucket 150 and the turnbuckle plate 125. In FIG. 5, the bucket 150 has the first mounting point 158 of the bucket 150 is bolted to the first armature mounting hole 128, and the second mounting point 159 of the bucket 150 is bolted to the second armature mounting hole 129. Bolts and nuts 180 are used to connect the bucket 150 to the armature 120 and optionally the turnbuckle 170. The turnbuckle 170 is well known in the art.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A reversible bucket attachment system for a vehicle comprising:

a mounting plate configured to attach to a vehicle;

an armature is permanently affixed to said mounting plate;

a bucket is bolted to said armature in order for said vehicle to drag said bucket in a forward or rearward orientation;

wherein the mounting plate is further defined with a forward surface and a rear surface; wherein the rear surface of the mounting plate includes attachment tabs thereon; wherein the attachment tabs are configured to attach to the vehicle directly;

wherein said attachment tabs work in concert with a top attachment bracket to adaptively secure the mounting plate onto a rear attachment member of the vehicle;

wherein the rear surface of the mounting plate is affixed to the armature;

wherein the armature is affixed to the rear surface of the mounting plate via a plurality of gusset members; wherein the armature is perpendicularly oriented with respect to the rear surface of the mounting plate;

wherein the armature includes an armature length that is not less than one foot in length;

wherein the armature is further defined with a top armature surface, and side armature surfaces; wherein the side armature surfaces include a first armature mounting hole and a second armature mounting hole; wherein the first armature mounting hole and the second armature mounting hole are used in connection with bolts to secure the bucket thereto;

wherein the first armature mounting hole is adjacent to an armature distal end whereas the second armature mounting hole is inset an armature mounting hole distance; wherein the top armature surface includes a turnbuckle plate; wherein the bucket is further defined with an inner surface having bucket teeth; wherein the bucket also has an outer surface; wherein the bucket has a leading bucket edge that forms an acute angle with respect to a ground surface when the bucket is attached to the armature with the inner surface and bucket teeth facing the vehicle;

wherein the bucket is able to be reversed and bolted to the armature with the outer surface engaging the ground surface and facing the vehicle;

wherein the bucket is further defined with a first mounting point and a second mounting point;

wherein the first mounting point is located adjacent the leading bucket edge;

wherein the second mounting point is provided adjacent the outer surface;

wherein the first mounting point of the bucket is bolted to the first armature mounting hole, and a turnbuckle connects between the second mounting point of the bucket and the turnbuckle plate;

wherein the bucket has the first mounting point of the bucket is bolted to the first armature mounting hole, and the second mounting point of the bucket is bolted to the second armature mounting hole;

wherein bolts and nuts are used to connect the bucket to the armature and the turnbuckle.

* * * * *